US006769941B2

(12) United States Patent
Norden

(10) Patent No.: US 6,769,941 B2
(45) Date of Patent: Aug. 3, 2004

(54) ELECTRICAL CONNECTORS

(75) Inventor: Alexander Roy Norden, Boca Raton, FL (US)

(73) Assignee: Eugene A. Norden, New York, NY (US)

( * ) Notice: Subject to any disclaimer, the term of this patent is extended or adjusted under 35 U.S.C. 154(b) by 0 days.

(21) Appl. No.: 10/288,125

(22) Filed: Nov. 5, 2002

(65) Prior Publication Data

US 2004/0087220 A1 May 6, 2004

(51) Int. Cl.[7] ..... H01R 11/09
(52) U.S. Cl. ..... 439/798; 439/797
(58) Field of Search ..... 439/798, 795, 439/796, 797, 799, 800, 801, 803

(56) References Cited

U.S. PATENT DOCUMENTS 3,133,779 A * 5/1964 Stanback ..... 439/798
3,794,963 A * 2/1974 Cooper, Jr. ..... 439/798
3,876,279 A * 4/1975 Underwood ..... 439/797
4,382,651 A * 5/1983 Klosin et al. ..... 439/359
4,427,258 A * 1/1984 Mueller ..... 439/814
4,640,571 A * 2/1987 Walter et al. ..... 439/791
4,778,412 A * 10/1988 Walter et al. ..... 439/798
5,021,014 A * 6/1991 Walter et al. ..... 439/798
5,690,516 A 11/1997 Fillinger ..... 439/798
6,579,131 B1 * 6/2003 Ashcraft et al. ..... 439/798

FOREIGN PATENT DOCUMENTS

EP 0 282 116 * 9/1988

* cited by examiner

*Primary Examiner*—Michael C. Zarroli

(57) ABSTRACT

The disclosed electrical connector, which connects a terminal stud to multiple branch-circuit wires, comprises two primary components of extruded metal: (A) a conductor having a first portion providing branch-circuit securing devices, and a second portion providing one or more stud-contacting areas; and (B) a clamp for securing a stud against a contact area; the clamp and said second portion provide a slip-fit stud-receiving passage.

14 Claims, 3 Drawing Sheets

ELECTRICAL CONNECTORS

This invention relates to electrical connectors for connecting a stud terminal of electrical equipment to multiple branch-circuit wires. A transformer is the electrical equipment referenced below, but the invention may be useful in other applications.

BACKGROUND

Various electrical connectors are known for connecting the studs of certain transformers to branch-circuit wires. In U.S. Pat. No. 5,690,516 issued Nov. 23, 1997 to D. R. Fillinger, mention is made of two series of connectors as being sold by Eritech, Inc., of Aberdeen, N.C., i.e., type UPSO "screw-on" connectors and type UPM "slip-fit" connectors. The '516 patent discloses another "slip-fit" connector, similar to the UPM series. The UPSO connectors and the UPM connectors as well as those disclosed in the '516 patent are all one-piece devices, as of extruded aluminum. A portion of the body of each of such connectors is an elongated conductor having transverse holes for branch-circuit wires and at each hole there is a clamping, wire-retaining screw. An additional hole of substantial diameter is provided in an end portion of the body of each such connector, for receiving an equipment stud, often a one-inch diameter screw-threaded stud.

Because the entire body of each of those connectors is a segmental length of an extrusion, its cross-section being so large as to accommodate entry of a stud, its cross-section is therefore excessive and wasteful for much if its length. Based on electrical and mechanical criteria, the cross-section of the elongated conductor portion of the connector could be much smaller than the cross-section required in the portion that is to receive the stud. However, due to the fact that the one-piece body of the connector is a segmental length of an extrusion, the cross-section of the entire body is as large as that required for its stud-receiving portion. In each of the slip-fit connectors of the UPM series and the slip-fit connectors of the '516 patent, the stud-receiving hole is distinctly larger than the stud diameter, to meet the slip-fit requirement. Additionally, an increased wall thickness is provided at the hole that is to provide for slip-fit admission of the stud, to provide support for the required stud-clamping screw. Because the entire body of the slip-fit connectors is notably larger in cross-section than would be needed for the branch-circuit-connecting portions of those connectors alone, the extrusion that is used to form one-piece slip-fit connectors has an excessively large cross-section all along most of its length.

The stud-receiving hole of UPM connectors has threads matching the pitch of the stud. It is noted in the '516 patent that, even though one or more clamping screw(s) is (are) provided at one side of the stud-receiving oversize hole in UPM slip-fit connectors, the stud may shift side-to-side despite being gripped, thereby developing instability of the stud-to-connector electrical contact. A smaller-diameter portion of a threaded hole is added in the '516 patent,opposite to the stud-clamping "jam" screw, intersecting the large-diameter slip-fit hole, for blocking the stud against side-to-side shifting in the oversize hole. Adopting terminology of the '516 patent, the jam screw is "above" the aligned "centers" of the large-diameter slip-fit hole and the smaller-diameter hole portion.

SUMMARY OF THE INVENTION

This invention provides a variety of novel slip-fit electrical connectors, each connector comprising first and second main components (disregarding clamping screws). For its entire length, the cross-section of the first component is an elongated conductor whose cross-section can be limited to that which is appropriate to provide for the composite branch-circuit currents and mechanical retention of the branch circuit-wires. An additional portion of the elongated conductor provides a contact area or areas for a terminal stud or for a selected, stud of either of two different diameters. That additional portion of the elongated conductor is freely exposed and accessible for machining operations that may be desirable. A second component of the novel connector is a clamp for gripping a terminal stud securely against said additional portion of the first component. Advantageously, segmental lengths of respective extrusions are used as the two components of the connector. The cross-section of each component of the novel connector can be limited to that which is essential for its own respective functions. Thus, the cross-section of the elongated branch-circuit-connection portion of the connector is not burdened, as in known one-component connectors, with material entailed in providing a stud-receiving hole.

In the following detailed descriptions and in the claims, the terminology has self-evident meanings. However, the clamp cooperates with a portion of the conductor that might be considered as having four "sides". The walls of the clamp grip a portion of the conductor that has two mutually opposite "sides" or "side surfaces". The conductor also has top or bottom surfaces contacted by a stud or studs or other electrical terminal, such surfaces being called "lateral surfaces" hereinafter.

Modifications of a preferred embodiment of the invention reveal further aspects of the invention. In the modifications, the elongated conductor component of the novel connector has shaped contact surfaces that conform selectively to terminal studs of two different diameters. In one embodiment, one lateral surface of an end portion of the elongated connector is shaped to provide proper contact areas for studs of different diameters. One relatively short length of clamping screw in the clamp is used for establishing stud-to-connector connection for a stud of one diameter and that screw is equally serviceable with a stud of a different diameter. One length of clamping screw serves with two different diameters of studs because the clamp is selectively mountable in different positions to adapt the connector to the different stud diameters. In another modification, studs of different diameters engage contact areas on respectively opposite lateral surfaces of the additional portion of the elongated conductor. The clamp can be selectively positioned to accommodate the selective positioning of the stud at the contact areas on different lateral surfaces.

In its distinctive novel form, the clamp is a "U"-shaped device having side walls and a wall-connecting bridge that bears a clamping screw or screws. The clamp acts, with the contact portion of the elongated conductor, to provide a slip-fit passage that receives the terminal stud. When a stud is in place in the stud-receiving passage, the clamping screw(s) may be tightened against the stud. Notably, the side walls of the clamp and the side surfaces of the elongated conductor which confront the clamp's side walls have mutually interlocking formations that arrest the clamp against shifting while clamping thrust is being developed by the clamping screw(s). In the embodiments of the invention shown in the accompanying drawings, the interlocking formations include projections, which may be called rails, extending from the inner surfaces of the clamp's side walls. In the form shown, the rails on the clamps and grooves in the elongated conductor have a dove-tail cross-section. Those interlocking formations arrest the clamp against shifting during tightening of the clamping screw or screws against a terminal stud; those formations also act in preventing the clamp's walls from spreading farther apart. By making the elongated conductor and the clamp as segmental lengths of extrusions, interlocking formations which are rails and grooves are provided at no expense for machining, and without limiting the shapes of their cross-sections. The inner surfaces of the clamp walls where those walls provide part of the slip-fit passage that receives a stud can also be shaped variously in the extrusion process, as may be desired.

The two-component form of the connector is economical in that each component is made of extruded stock whose cross-section can be made no larger than is needed for that component alone. The novel connector enables use of an extrusion for the elongated conductor whose cross-section can be much smaller than the extrusion that would be needed for the body of a one-piece connector. In its preferred embodiments, the clamp acts with the elongated conductor so as to form a stud-receiving passage for admitting either the large-diameter stud or the smaller-diameter stud, e.g., a stud of one-inch diameter or a stud of ⅝-inch diameter.

The stud-engaging contact surfaces on a lateral surface or surfaces of the elongated conductor bear(s) segments of screw threads that match the pitch and diameter of the gripped terminal stud, for arresting the connector against being pulled off the stud. A clamping screw or screws at one side of the stud drive(s) the stud into stable contact, mechanically and electrically with the selected contact area of the elongated conductor.

Illustrative embodiments of the invention described below, and shown in the accompanying drawings, represent presently preferred forms of the novel connectors. Those skilled in the art will readily devise variations and adaptations of the novel features as improvements of other electrical connectors. In modified forms, advantageous portions of the connector might be omitted together with their functions, retaining other novel features. The appended claims should be construed broadly, to encompass those variations and adaptations.

The illustrative embodiments of the invention which are shown in the accompanying drawings are presently preferred forms of the novel connectors. Further novel aspects of the present invention will be noted and better appreciated from the detailed descriptions that follow. In those descriptions much of the terminology has self-evident meanings, but note the definitions of "side" and "side surfaces", and "lateral surface" that appear above.

BRIEF DESCRIPTION OF THE DRAWINGS

FIG. 3A shows the clamp mounted in position to receive a relatively large-diameter stud;

FIG. 4 shows a clamp positioned to grip a large-diameter stud;

DETAILED DESCRIPTION OF THE APPARATUS IN THE DRAWINGS

Figure 1:
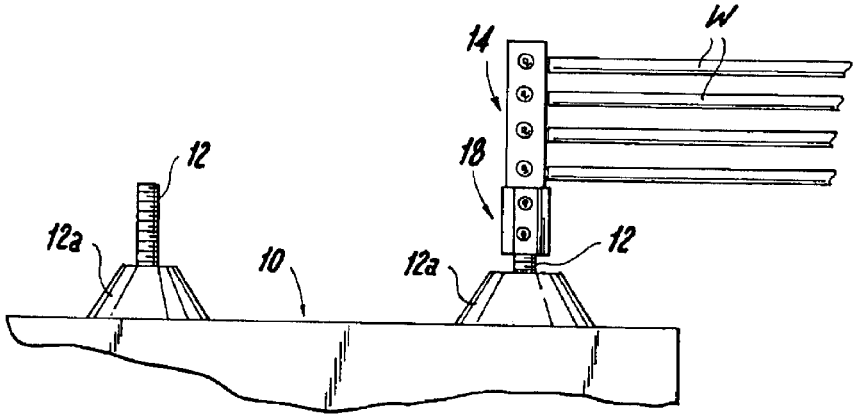
FIG. 1 is a lateral fragmentary view of a transformer bearing two studs and a reduced-scale view of a novel connector that connects one of those studs to a number of branch-circuit wires.

Referring now to the drawings, FIG. 1 shows a fragment of a unit of electrical equipment 10, a transformer for example, bearing two illustrative screw-threaded studs 12, as of copper, that extend through supporting insulators 12*a*. A novel connector 14 on one of the studs connects multiple circuit wires W to one of the studs.

Figure 7:
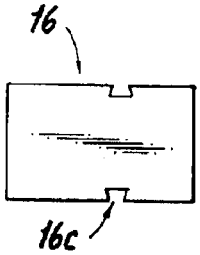
FIG. 7 is a top or end view of one component of the connector of FIG. 2.

Connector 14 (FIGS. 2 and 3) consists of two components (disregarding clamping screws), namely an elongated conductor 16 and a clamp 18. Conductor 16 is made of an extrusion an end of which is shown in FIG. 7, its cross-section having the same shape uniformly along its length as the shape of its end. It is made of a ductile electrically conductive metal, ordinarily aluminum. The extrusion is cut to the required segmental length and it is subjected to a limited number of machining operations. A series of transverse holes 20 are drilled through conductor portion 16*a* and the extrusion is tapped at each hole to receive a wire-clamping screw 22 for wires W.

An end portion 16*b* of conductor 16 is occupied by clamp 18. This clamp includes side walls 18*a* and a clamp-unifying wall-to-wall bridge 18*b*. The thickness of the bridge is appropriate to sustain threaded clamping screw or screws 18*c*, enabling the screws to apply the necessary pressure to an inserted stud. Side walls 18*a* bear inward-projecting rails 18*d* which extend all across the clamp and which slide in grooves 16*c* in the opposite sides of extrusion 16'. The grooves extend all along the extrusion. The cross-section of the rails and the grooves in which they are slidable renders them mutually interlocking, to hold the clamp in place as the screws build up pressure against the stud. Those interlocking formations act additionally to block any tendency of the clamp's walls 18*a* to spread outward when clamping screws 18*c* are tightened against a stud. The dove-tail shape of the cross-section of each rail and its receiving groove as shown is optimal, but other shapes may be adopted, as desired. The form of rails 18*d* and the grooves 16*c* that are shown and described provides assurance that the clamp will remain securely interlocked with the elongated conductor.

Figure 2:
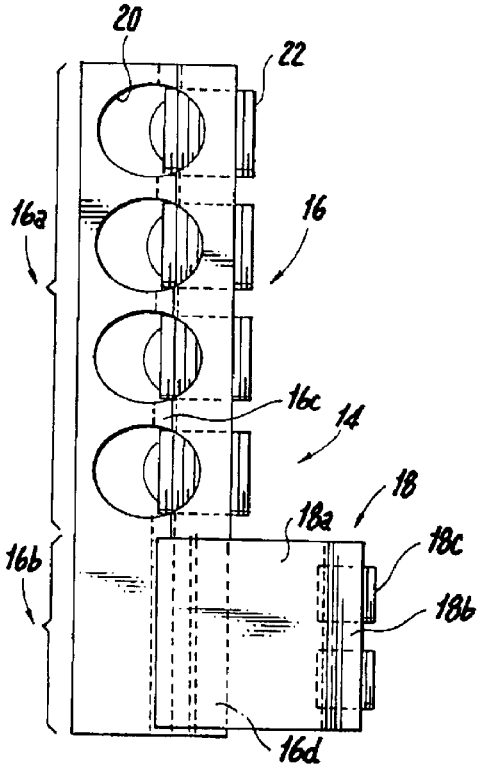
FIG. 2 is a side view of an illustrative novel connector and FIG. 3 is its bottom view.
Figure 3:
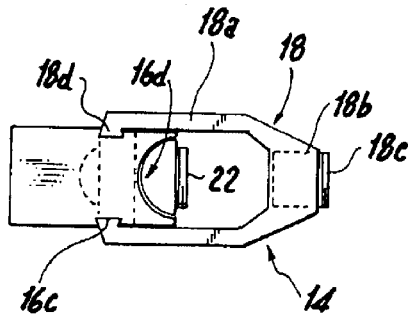

Clamps 18 are produced economically as a segmental length of an extrusion (not shown) whose cross-section matches the desired cross-section of the clamp, for example the shape shown in FIGS. 2 and 3, its walls being spaced amply to accommodate the stud. The rails 18*d* are produced at no cost other than the extrusion process itself. Grooves 16*c* are also produced at no cost, inasmuch as they result from the extrusion process. The direction of extrusion of the elongated conductor and that of the clamp are parallel. Grooves 16*c* and rails 18*d* are parallel to the direction of extrusion. Clamp 18 and end portion 16*b* of the elongated conductor form a passage that freely receives stud 12, thus providing for slip-fit of the assembly onto a stud. The studs are standardized, having prescribed diameters and threads whose pitch is also prescribed. Channel 16*d* is formed by a suitable machining operation in end portion 16*b* of the elongated conductor. The machining operations may include drilling so as to form a channel or the channel may be formed with an end mill. The channel has segmental screw threads that mate with a screw-threaded stud, for preventing the connector from being pulled off a stud on which the connector is mounted. Channel 16*d* is a contact area for the stud, conveniently formed in component 16 when its end portion 16*b* is accessible, i.e., before a clamp 18 is in place. The machining operations used in forming channel 16*d* may initially involve end-milling or drilling for forming a simple channel, followed by a screw-tapping operation or by coining to provide the channel with segmental screw threads. (The outermost end of channel 16*d* is represented in the drawings by solid lines, because that end of the channel is chamfered.) Because end portion 16*b* of the elongated conductor 16 is freely exposed at this time, the machining operations are facilitated.

The connector of FIGS. 2 and 3 is designed for the "larger" of two stud diameters considered elsewhere in this specification, e.g., for a one-inch diameter stud. In use, the clamp and the elongated conductor may be assembled as shown in these Figures, and that assembly is slip-fit onto one of the terminal studs. Conductor portion 16*b* cooperates with clamp 18 to constitute a passage for slip-fit entry of a stud. As an alternative, a clamp 18 may be positioned against a stud, and elongated conductor portion 16*b* may then be placed against the stud with its grooves 16*c* aligned with rails 18*d* of the clamp. The assembly of the clamp on the elongated conductor is completed by sliding the elongated conductor into assembly with the clamp or vice versa, the clamp may be slipped into assembly with the elongated conductor. Tightening of screws 18*c* at one side of the stud drives the stud against contact area 16*d* of conductor portion 16*b*, thus mounting the connector on a terminal stud. Wires W are then inserted into holes 20 and screws 22 are tightened to secure the wires in the holes. The stud-to-conductor contact is unaffected by stresses applied to the clamping screws or to the wires.

Figure 3A:
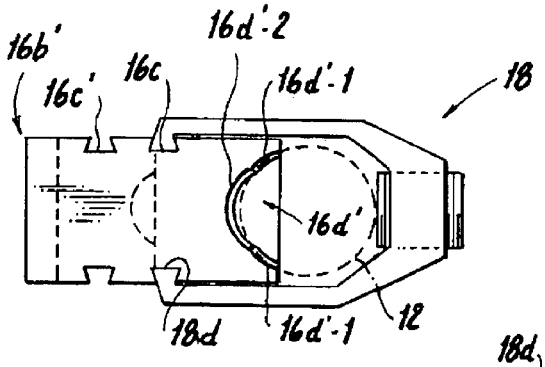
FIG. 3A is a bottom view of a modification of the connector of FIGS. 2 and 3, this modification being suitable for mounting the connector selectively on studs of either of two different diameters.
Figure 3B:
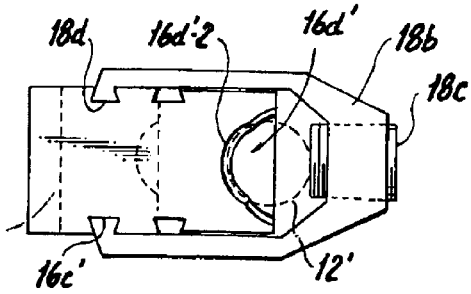
FIG. 3B is a bottom view of the connector of FIG. 3A with its clamp mounted in position to receive a relatively small-diameter stud.

FIGS. 3A and 3B illustrate a modification of the connector of FIGS. 2 and 3, to accommodate either of two stud diameters, e.g., one-inch diameter or ⅝-inch diameter. The same numerals are used in FIGS. 3A and 3B as in FIGS. 2 and 3 to represent corresponding parts, whose description is not repeated in the interest of brevity. For adapting the same connector of FIGS. 2 and 3 for use with studs of two different diameters, channel 16*d*' in FIGS. 3A and 3B is formed in end portion 16*b*' of the elongated conductor by those initial machining operations that are used in making channel 16*d* (as for only a one-inch diameter stud), and then a segmental channel 16*d*'-2 is machined in the bottom of the initially formed channel to mate with the smaller-diameter stud, e.g., to mate with a ⅝-inch diameter stud. The end result is that channel 16*d*' has two mutually separated ridges 16*d*'-1 that bear segmental threads and mate with a large-diameter stud 12 (the one-inch diameter stud in the example) and there is a secondary channel 16*d*'-2, between the pair of ridges 16*d*'-1. This smaller-diameter channel 16*d*'-2 bears segmental threads and the channel mates with a smaller-diameter stud 12' (the ⅝-inch diameter stud in the example). When the large-diameter stud is to be used, as shown in FIG. 3A, paired rails 18*d* of the clamp are received in paired grooves 16*c* of the conductor portion 16*b*'. With the parts in this configuration, screws 18*c* are of a length that is appropriate to drive the stud against threaded ridges 16*d*'-1. When the connector is to be used with the smaller-diameter stud 12' in FIG. 3B, pairs of rails 18*d* of the clamp are received in paired grooves 16*c*'. These grooves are formed in the process of producing the extrusion 16' of this modification; grooves 16*c*' extend all along the elongated conductor. Grooves 16*c*' are so located that the same screws 18*c* can be used with the smaller-diameter studs 12'. Expressed in other terms, the space between bridge 18*b* of the clamp and the contact area on portion 16*b*' is coordinated with the diameter of the stud that is to be gripped. Such coordination is arranged by properly locating grooves 16*c* and 16*c*'. Selective location of the clamp on the conductor portion 16*b*' avoids the complication of requiring clamping screws of different lengths when the connector is to be used with studs of different diameters.

Figure 4:
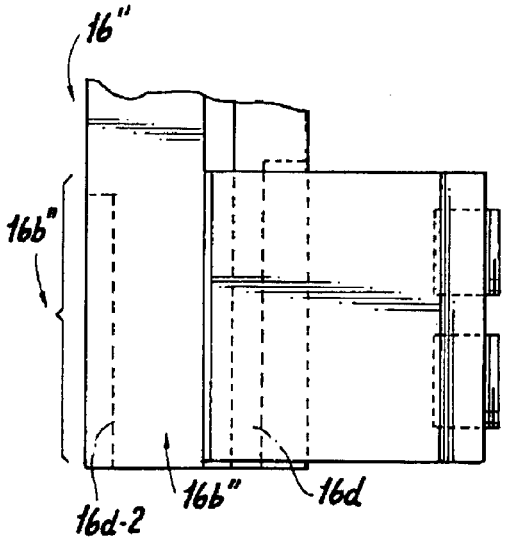
FIG. 4 is a fragmentary side view of another modification of the embodiment shown in FIG. 2, suitable for selective use with two different stud diameters.
Figure 4A:
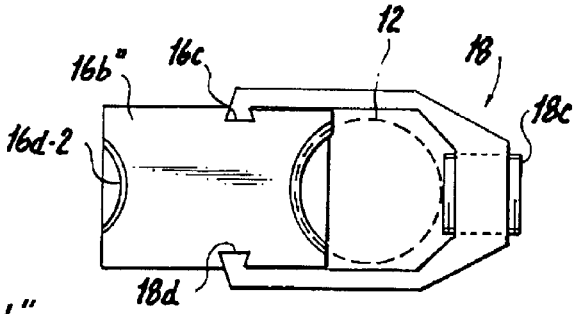
FIG. 4A is a bottom view of the connector of FIG. 4.
Figure 4B:
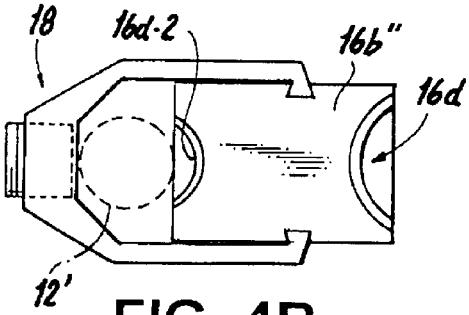
FIG. 4B is a bottom view of the connector of FIG. 4 with its clamp positioned for cooperation with a small-diameter stud.

FIGS. 4, 4A and 4B illustrate a further modification. The same reference numerals are used in these Figures as in FIGS. 2 and 3 to represent corresponding parts. FIGS. 4, 4A and 4B represent a connector suitable for use with two different stud sizes, e.g., studs of 5/8-inch diameter and studs of one-inch diameter. Elongated conductor 16" in the modification of FIGS. 4, 4A and 4B closely resembles elongated conductor 16 in FIGS. 2 and 3, but there are two differences. First, elongated conductor 16" has not only the threaded channel 16*d* of FIGS. 2 and 3, to mate with the larger size of stud but, additionally, a second channel 16*d*-2 is machined in the lateral surface of conductor portion 16" opposite to the lateral surface where channel 16*d* is formed. Both channels 16*d* and 16*d*-2 are machined in the end portion 16*b*" of the elongated conductor before clamp 18 is in place, so that the appropriate machining operations can be performed without obstruction. Second, the cross-section of elongated conductor 16" and the depth of channel 16*d*-2 are proportioned so that rails 18*d* of clamp 18 are received in grooves 16*c*. Clamp 18 (including its screws 18*c*), cooperates properly with the gripped studs in both of the conditions represented in FIGS. 4A and 4B. (This refinement of using the same grooves 16*c* in FIGS. 4A and 4B for large-diameter studs 12 and small-diameter studs 12' can be bypassed by using two pairs of grooves 16*c* and 16*c*' as in FIGS. 3A and 3B.)

In FIG. 4A, clamp 18 has its rails 18*d* in grooves 16*c*, exactly as in FIG. 3. FIG. 4B shows clamp 18 in position to drive a smaller-diameter stud 12' against channel 16*d*-2 with its rails 18*d* in grooves 16*c*. To attain this result, channel 16*d*-2 should be judiciously located so that the same clamping screws 18*c* can be used in either condition of the clamp, that shown in FIG. 4A or that shown in FIG. 4B. Alternatively, a second pair of grooves as in FIGS. 3A and 3B may be provided in conductor 16" in the embodiment of FIGS. 4, 4A and 4B to enable the clamp to cooperate with studs of two different diameters without changing screws 18*c*.

In each of the embodiments described above, reference is made to "channels" that are cut in the elongated conductor by a drill or by means of an end mill. Those channels basically constitute the "contact areas" of the connector for the studs. Segments of screw threads are formed using a screw-thread-forming tap or the segments of screw threads may be coined in previously drilled or end-milled channels in the conductor portion 16*b*". The finished contact areas accordingly have screw threads that match the diameter and pitch of the screw threads of the stud that is to be gripped. The end result is to lock the connector against being pulled off the stud.

Contact area 16*d* shown in FIG. 3 is intended for a large-diameter stud, e.g., one-inch diameter. (Contact area 16*d* is represented in double solid lines because the contact area is a partial-cylindrical channel that is chamfered at its end.) The modified form of contact area in FIGS. 3A and 3B (indicated generally by the numeral 16*d*' and its arrow-head lead line) is intended for use selectively with studs of two different diameters, e.g., one-inch diameter and ⅝-inch diameter. Contact area 16*d*' is divided by central channel 16*d*'-2 into two arcuately concave ridges 16*d*'-1 that mate with portions of a larger-diameter stud, e.g., of one-inch diameter. Central channel 16*d*'-2 mates with a smaller-diameter stud, e.g., ⅝-inch diameter. All three portions of channel 16*d*' have screw-thread formations so that either size of stud that may be selected will be locked in the connector when the clamp is tightened.

In FIG. 3, the clamp is positioned to receive a stud of one-inch diameter, its rails 18*d* being received in paired grooves 16*c*. The modification of FIGS. 3A and 3B has two pairs of grooves 16*c* and 16*c*'. When the connector is used with a larger-diameter stud (one-inch in the example given) rails 18*d* are received in grooves 16*c* as shown in FIG. 3. To adapt the connector for use with a small-size stud, e.g., ⅝-inch diameter, rails 18*d* of the clamp are fitted in grooves 16*c*' as shown in FIG. 3B. This is an improvement that enables the same screws 18*c* to be used with both sizes of studs. Of course, one pair of grooves 16*c* would suffice if two sizes of clamping screws were provided or if an overly long screw or screws were used for both sizes of studs.

Figure 5:
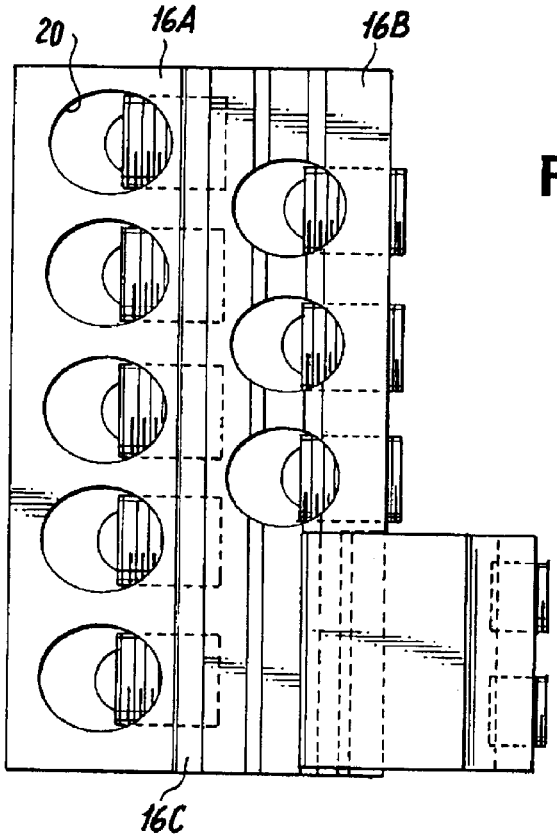
FIG. 5 is the side view of a modification of the connector of FIG. 2.
Figure 6:
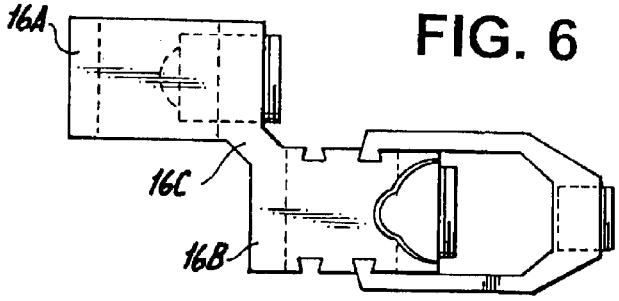
FIG. 6 is a bottom view of the connector shown in FIG. 5.
Figure 8:
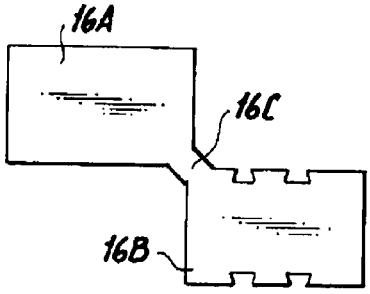
FIG. 8 is a top or end view of one component of the connector of FIGS. 5 and 6.

FIGS. 5 and 6 show a connector that is in all respects a duplicate of that in FIGS. 2 and 3, except that, in FIGS. 5 and 6 the elongated conductor 16 of FIGS. 2 and 3 includes an extrusion (FIG. 8) comprising portions 16A and 16B unified by a web 16C. Elongated conductors 16A and 16B in FIGS. 5 and 6 have respective sets of wire-receiving holes 20 and wire-gripping screws 22, off-set from one another for convenient access. The remainder of FIGS. 5 and 6 needs no detailed description, inasmuch as it will be understood from the descriptions of the embodiment of FIGS. 2 and 3, and the modification of FIGS. 3A and 3B.

The foregoing detailed description of illustrative embodiments of the invention includes specific mention of some modifications and equivalent structures, but other modifications and equivalents will be apparent to those skilled in the art. Therefore the appended claims should be construed broadly, consistent with the spirit and scope of the invention.

What is claimed is:

1. An electrical connector for connecting a terminal stud of an electrical unit to multiple branch circuits, said connector comprising an elongated conductor, a first portion of said elongated conductor having at least one series of transverse holes and a wire-clamping screw for each hole, for receiving and securing branch-circuit conductors, a second portion of said elongated conductor having an external side contact area for engagement by said terminal stud, said connector additionally comprising a clamp for holding said terminal stud of due electrical unit tightly in engagement with said external side contact area of said second portion of said elongated conductor, said clamp comprising a device having mutually spaced-apart walls that flank said second portion of the elongated conductor and said device having a bridge that unifies said walls, said bridge and said mutually spaced-apart walls and the external side contact area of said second portion of the elongated conductor constituting a passage for receiving a terminal stud which is thus constrained to extend along the second portion of the elongated conductor, and said bridge having one or more screws for driving a terminal stud when in said passage against said external side contact area, said walls of said device and said second portion of the elongated conductor having mutually interlocking formations configured to block the bridge against shifting in the direction away from the external side contact area when the screw or screws is (are) tightened.

2. An electrical connector as in claim 1 wherein said mutually interlocking formations extend parallel to the direction of elongation of said second portion of the elongated conductor.

3. An electrical connector as in claim 2, wherein said elongated conductor and said clamp are segmental lengths of first and second metal extrusions, said mutually interlocking formations being respective portions of sad segmental lengths of said first and second metal extrusions.

4. An electrical connector as in claim 3 for use with terminal studs that are threaded, wherein said external side contact area of the elongated conductor has segmental threads that mate with the threaded terminal stud when engaged thereby.

5. An electrical connector as in claim 1 for use alternatively with studs of two different diameters wherein said second portion of said elongated conductor has a second external side contact area, such external side contact areas being shaped to conform to respective portions of said terminal studs of different diameters and wherein said clamp and said second portion of the elongated conductor have interlocking formations adapting the clamp to be disposed selectively in position to grip a terminal stud in contact with said contact areas, selectively.

6. An electrical connector as in claim 5, wherein said external side contact areas are on the same external side surface of the second portion of the elongated conductor.

7. An electrical connector as in claim 5 wherein said external side contact areas are on opposite external side surfaces of the second portion of the elongated conductor.

8. An electrical connector for connecting an electrical terminal stud to multiple branch circuits, said connector comprising a first metal extrusion, a first portion of said first metal extrusion being elongated and having devices for making connections to multiple branch circuits and a second portion of said first metal extrusion being elongated and having a pair of opposite sides and having an external side surface between said opposite sides, said connector additionally comprising a clamp having a pair of walls that confront said opposite sides of the second portion of the metal extrusion and said clamp comprising a bridge that unifies said walls, said bridge and said walls and said external side surface defining a passage for slip-fit admission of an electrical terminal stud, each of said walls and a respective side of said second elongated portion of said first metal extrusion having elongated interlocking formations effective to block the bridge against shifting in the direction farther from said external side surface, the bridge of said clamp having a screw or screws for driving an electrical terminal stud that may be disposed in said passage against said external side surface.

9. An electrical connector as in claim 8, wherein said clamp is a segmental length of a second metal extrusion, the clamp being elongated parallel to the length of said second portion of the first extrusion and all of said interlocking formations extending all along their respective first and second extrusions.

10. An electrical connector as in claim 8, wherein the formations of said walls are projecting rails and wherein the formations of said first extrusion are grooves that receive respective rails of the clamp.

11. An electrical connector as in claim 10, wherein said electrical terminal stud is a threaded terminal stud and wherein said external side surface comprises a channel bearing segmental screw threads to mate with a portion of a said threaded terminal stud.

12. An electrical connector as in claim 5 for use with terminal studs of either of two diameters, said interlocking formations being suitably located and sufficient in number so that a screw or screws of the clamp may be of a common length is (are) effective to drive either one of said terminal studs against its corresponding external contact area.

13. An electrical connector as in claim 8 for use with an electrical terminal stud that is threaded, wherein said external contact area has formations that conform to portions of said threaded terminal stud.

14. An electrical connector as in claim 13, wherein said elongated conductor is a segmental length of a first metal extrusion and wherein said clamp comprises a "U" shaped device that is a segmental length of a second metal extrusion, said mutually interlocking formations being respective portions of said segmental lengths of said first and second metal extrusions.

* * * * *